US008608456B2

(12) United States Patent
Hishinuma et al.

(10) Patent No.: US 8,608,456 B2
(45) Date of Patent: Dec. 17, 2013

(54) HIGH PRESSURE PUMP

(75) Inventors: Osamu Hishinuma, Toyota (JP); Tatsuro Koga, Kariya (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 163 days.

(21) Appl. No.: 13/353,719

(22) Filed: Jan. 19, 2012

(65) Prior Publication Data

US 2012/0180649 A1 Jul. 19, 2012

(30) Foreign Application Priority Data

Jan. 19, 2011 (JP) ..... 2011-008835

(51) Int. Cl.
*F04B 49/00* (2006.01)
*F02M 41/00* (2006.01)
*F02M 37/04* (2006.01)

(52) U.S. Cl.
USPC ..... 417/308; 417/307; 123/446; 123/448; 123/506

(58) Field of Classification Search
USPC ..... 417/300, 307, 308, 454; 123/445–448, 123/456, 457, 459, 495, 506
See application file for complete search history.

(56) References Cited

U.S. PATENT DOCUMENTS

| | | | | |
|---|---|---|---|---|
| 7,152,583 | B2 * | 12/2006 | Abe et al. | 123/446 |
| 8,070,462 | B2 * | 12/2011 | Inoue | 417/307 |
| 8,075,287 | B2 * | 12/2011 | Inoue | 417/571 |
| 8,206,131 | B2 * | 6/2012 | Suzuki et al. | 417/307 |
| 8,297,941 | B2 * | 10/2012 | Suzuki et al. | 417/307 |
| 2011/0114064 | A1 * | 5/2011 | Akita et al. | 123/495 |
| 2011/0139126 | A1 * | 6/2011 | Inoue | 123/506 |

FOREIGN PATENT DOCUMENTS

JP 2010-48259 3/2010

* cited by examiner

*Primary Examiner* — Peter J Bertheaud
(74) *Attorney, Agent, or Firm* — Nixon & Vanderhye P.C.

(57) ABSTRACT

At least one choked flow passage communicates between one side of the movable member and the other side of the movable member and limits an amount of fuel, which passes from the one side of the movable member to the other side of the movable member, when the movable member is moved by an urging force of a relief spring toward a valve element. A larger amount of fuel, which is larger than the amount of fuel that is passable through the at least one choked flow passage, flows from a first return flow passage to a second return flow passage, when the movable member is moved toward the other side, which is opposite from the valve element, against the urging force of the relief spring.

3 Claims, 11 Drawing Sheets

HIGH PRESSURE PUMP

CROSS REFERENCE TO RELATED APPLICATION

This application is based on and incorporates herein by reference Japanese Patent Application No. 2011-8835 filed on Jan. 19, 2011.

BACKGROUND OF THE INVENTION

1. Field of the Invention

The present invention relates to a high pressure pump.

2. Description of Related Art

A fuel supply apparatus, which supplies fuel to an internal combustion engine, includes a high pressure pump, a fuel rail and fuel injection valves. The high pressure pump pumps high pressure fuel. The fuel rail accumulates the high pressure fuel, which is pumped from the high pressure pump. The fuel injection valves are connected to the fuel rail and inject the high pressure fuel received from the fuel rail. The pressure of the fuel rail may possible exceed its allowable range due to, for example, malfunction of an intake valve or a discharge valve of the high pressure pump or abnormal temperature increase, thereby resulting in an abnormally high pressure of the fuel rail. In order to address such a disadvantage, a previously proposed high pressure pump includes a relief valve that relieves, i.e., releases an excessively high pressure, which is equal to or higher than a predetermined relief pressure, to a return passage, so that damage of, for example, the fuel injection valve(s) can be limited.

When the engine is stopped, circulation of the engine coolant is stopped. This results in an increase in the temperature of the engine room. In response to the increase in the temperature of the engine room, the pressure of the fuel rail is increased, so that fuel may possibly leak from the fuel injection valves. Furthermore, when the temperature of the fuel in the fuel rail is increased beyond the evaporating temperature of the fuel, fuel vapor may possibly be generated in the fuel rail. When the generated vapor is accumulated in the fuel rail or is injected from the fuel injection valves along with the fuel, the startability of the engine may possibly be deteriorated.

In view of the above disadvantage, JP2010-48259A teaches a high pressure fuel supply apparatus, which includes a check valve in a relief valve. This check valve opens when the pressure of fuel in the fuel rail is larger than a predetermined pressure to enable flow of fuel from the fuel rail to a discharge valve located on an upstream side of the fuel rail. The predetermined pressure is set such that the amount of fuel leaked from the fuel injection valve upon the engine stop becomes smaller than its allowable amount, and the amount of vapor generated in the fuel rail upon the engine stop becomes smaller than its allowable amount.

With the technique of JP2010-48259A, it is possible to reduce the required installation space by placing the check valve in the relief valve. However, according to this technique, the check valve and the relief valve are separately formed. Therefore, a valve element and a valve seat of each of the check valve and the relief valve need to be accurately formed to a level that ensures fluid tightness between the valve element and the valve seat. Therefore, the number of processing steps and the processing costs may possibly be increased.

SUMMARY OF THE INVENTION

The present invention addresses the above disadvantage.

According to the present invention, there is provided a high pressure pump, which includes a plunger, a cylinder, a discharge valve, a housing, a valve element, a movable member, valve element urging means and movable member urging means. The cylinder receives the plunger. The plunger is axially reciprocatable in the cylinder and forms a pressurizing chamber in cooperation with the cylinder to pressurize fuel in the pressurizing chamber upon reciprocation of the plunger in the cylinder. The discharge valve is provided at an outlet of the pressurizing chamber. The housing includes a first return flow passage, a second return flow passage, a valve receiving hole and a valve seat. The first return flow passage is communicated with an outlet of the discharge valve. The second return flow passage is communicated with an inlet of the discharge valve. The valve receiving hole is formed between the first return flow passage and the second return flow passage. The first return flow passage opens to the valve receiving hole. The valve seat is formed at an opening of the first return flow passage. The valve element is received in the valve receiving hole. The valve element is adapted to be seated against the valve seat when a pressure of fuel at an outlet side of the discharge valve is equal to or smaller than a predetermined value, and the valve element is adapted to be lifted away from the valve seat when the pressure of fuel at the outlet side of the discharge valve is larger than the predetermined value. The movable member is received in the valve receiving hole on a side of the valve element, which is opposite from the valve seat and is movable in an axial direction of the valve receiving hole. The valve element urging means is for urging the valve element in a closing direction of the valve element toward the valve seat. The valve element urging means is placed between the valve element and the movable member. The movable member urging means is for urging the movable member toward the valve element by an urging force, which is larger than an urging force of the valve element urging means. At least one choked flow passage is formed between one side of the movable member, at which the valve element is located, and the other side of the movable member, which is opposite from the valve element. The at least one choked flow passage communicates between the one side of the movable member and the other side of the movable member and limits an amount of fuel, which passes from the one side of the movable member to the other side of the movable member, when the movable member is moved by the urging force of the movable member urging means toward the valve element. A larger amount of fuel, which is larger than the amount of fuel that is passable through the at least one choked flow passage, flows from the first return flow passage to the second return flow passage, when the movable member is moved toward the other side, which is opposite from the valve element, against the urging force of the movable member urging means.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Various embodiments of the present invention will be described with reference to the accompanying drawings.

First Embodiment

Figure 1:
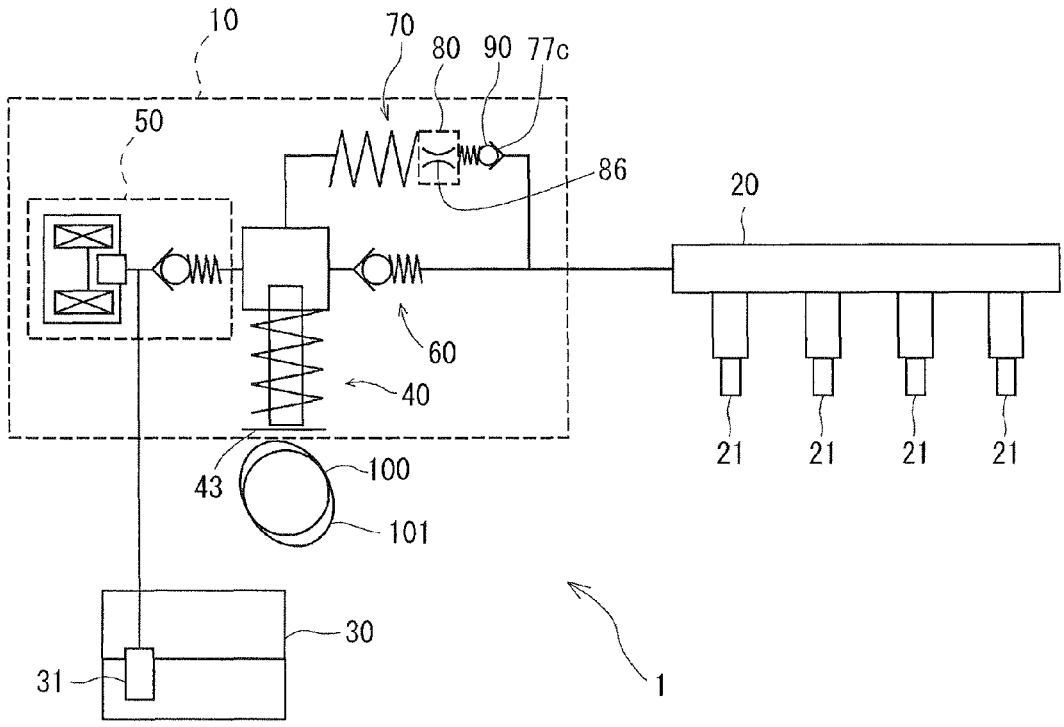
FIG. 1 is a schematic diagram indicating a fuel supply apparatus having a high pressure pump according to a first embodiment of the present invention.

FIG. 1 shows a fuel supply apparatus, in which a high pressure pump of a first embodiment of the present invention is applied. The fuel supply apparatus 1 includes the high pressure pump 10 and a fuel rail 20.

The high pressure pump 10 pressurizes fuel supplied from a fuel tank 30 by a low pressure pump 31 and discharges the pressurized fuel as high pressure fuel. The fuel rail 20 accumulates the discharged fuel. A plurality of fuel injection valves 21 is connected to the fuel rail 20. In the present embodiment, the number of the fuel injection valves 21 connected to the fuel rail 20 is four.

Next, the structure of the high pressure pump 10 will be described with reference to FIGS. 2 to 5C.

As shown in FIG. 1, the high pressure pump 10 includes a plunger arrangement 40, a intake valve arrangement 50, a discharge valve arrangement 60 and a check valve/relief arrangement 70.

Figure 2:
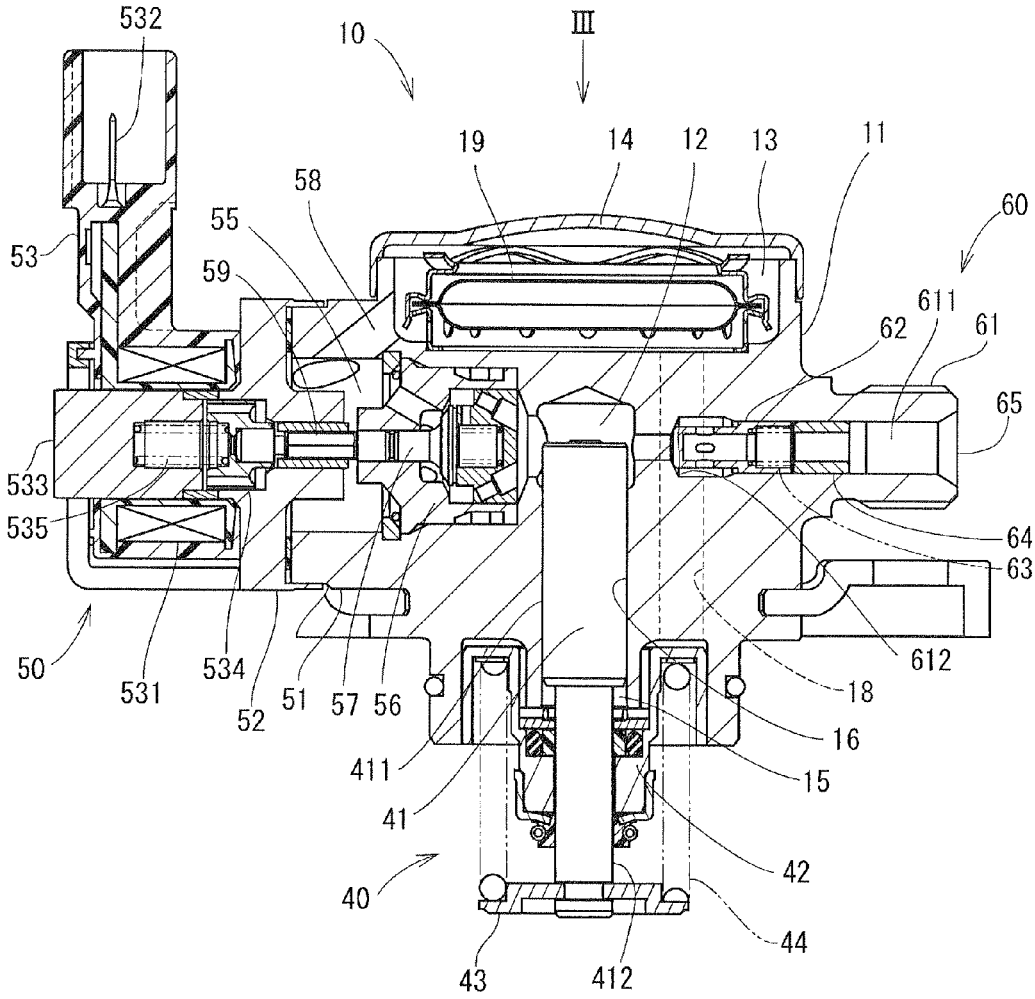
FIG. 2 is a cross sectional view of the high pressure pump of the first embodiment.

As shown in FIG. 2, a pump body 11 forms an outer shell of the high pressure pump 10. A cover 14 is installed to the pump body 11 at an upper side in FIG. 2. A fuel chamber 13 is formed by the cover 14 and the pump body 11. A pulsation damper 19 is placed in the fuel chamber 13 to damp pressure pulsation of fuel.

The plunger arrangement 40 is provided on the other side of the pump body 11, which is opposite from the cover 14. A pressurizing chamber 12, in which fuel is pressurized, is formed between the plunger arrangement 40 and the fuel chamber 13.

Fuel is supplied into the fuel chamber 13 by the low pressure pump 31 from the fuel tank 30 (see FIG. 1). The fuel, which is supplied to the fuel chamber 13, is discharged from the discharge valve arrangement 60 to the fuel rail 20 upon passing through an intake chamber 55 and the pressurizing chamber 12.

Next, the plunger arrangement 40 will be described.

The plunger arrangement 40 includes a plunger 41, a plunger seal device 42, a spring seat 43 and a plunger spring 44.

The plunger 41 includes a large diameter portion 411 and a small diameter portion 412, which are formed integrally and reciprocate together in an axial direction of the plunger 41. An outer diameter of the large diameter portion 411 is larger than that of the small diameter portion 412. The large diameter portion 411, which is formed on the pressurizing chamber 12 side, slides along an inner peripheral wall of the cylinder 16.

A variable volume chamber 15, which is an annular chamber surrounded by the inner peripheral wall of the cylinder 16, is formed around the small diameter portion 412. The variable volume chamber 15 is communicated with the fuel chamber 13 through a volume chamber passage 18. At the time of downward movement of the plunger 41, fuel is supplied from the variable volume chamber 15 to the fuel chamber 13. At this time, the amount of fuel, which is supplied from the variable volume chamber 15 to the fuel chamber 13, corresponds to the amount of reduction in the volume of the variable volume chamber 15. Furthermore, at the time of upward movement of the plunger 41, fuel is supplied from the fuel chamber 13 to the variable volume chamber 15. At this time, the amount of fuel, which is supplied from the fuel chamber 13 to the variable volume chamber 15, corresponds to the amount of increase in the volume of the variable volume chamber 15.

The plunger seal device 42 is placed at an end portion of the cylinder 16. The plunger seal device 42 includes a seal member, an oil seal holder and an oil seal and seals fuel and oil around the plunger 41.

The spring seat 43 is placed at an end portion of the plunger 41. The end portion of the plunger 41 contacts a tappet (not shown). An outer surface of the tappet contacts a cam 101, which is installed to a camshaft 100 in an engine block. When the camshaft 100 is rotated, the tappet is axially reciprocated according to a cam profile of the cam 101 (see FIG. 1).

One end of the plunger spring 44 contacts an upper surface of spring seat 43, and the other end of the plunger spring 44 contacts a recessed surface of the oil seal holder inserted into the pump body 11. The plunger spring 44 functions as a return spring of the plunger 41. The plunger spring 44 urges the spring seat 43 against the tappet to urge the tappet against the cam surface.

With the above construction, the plunger 41 is reciprocated in response to the rotation of the camshaft 100. At this time, a volume of the pressurizing chamber 12 is changed through the movement of the large diameter portion 411 of the plunger 41.

Next, the intake valve arrangement 50 will be described.

The intake valve arrangement 50 includes a tubular portion 51, a valve cover 52 and a connector 53. The tubular portion 51 is formed by the pump body 11. The valve cover 52 covers an opening of the tubular portion 51.

The tubular portion 51 is configured into a generally cylindrical tubular form, and the intake chamber 55 is formed in the tubular portion 51. A seat body 56, which is configured into a generally cylindrical tubular form, is placed in the intake chamber 55. An intake valve 57 is placed in an inside of the seat body 56. The intake chamber 55 is communicated with the fuel chamber 13 through a communication passage 58.

A needle 59 contacts the intake valve 57. The needle extends into an inside of the connector 53 through the valve cover 52. The connector 53 includes a coil 531 and a plurality of terminals 532. An electric current is supplied to the coil 531 through the terminals 532. A stationary core 533, a movable core 534 and a spring 535 are placed on a radially inner side of the coil 531. The stationary core 533 is held in a predetermined location. The spring 535 is interposed between the stationary core 533 and the movable core 534. The movable core 534 is integrally securely joined to the needle 59.

With the above construction, when the coil 531 is energized through the terminals 532 of the connector 53, a magnetic attractive force is generated between the stationary core 533 and the movable core 534. Therefore, the movable core 534 is moved toward the stationary core 533. Thereby, the needle 59 is moved in a direction away from the pressurizing chamber 12. At this time, the movement of the intake valve 57 is not limited by the needle 59, so that the intake valve 57 can seat against the seat body 56. When the intake valve 57 is seated against the seat body 56, the intake chamber 55 and the pressurizing chamber 12 are disconnected from each other.

In contrast, when the coil 531 is not energized, the magnetic attractive force is not generated. Therefore, the movable core 534 and the needle 59 are moved toward the pressurizing chamber 12. Then, the intake valve 57 is held at the pressurizing chamber 12 side by the needle 59. Thus, the intake valve 57 is lifted away from the seat body 56, and thereby the intake chamber 55 and the pressurizing chamber 12 are communicated with each other.

Figure 3:
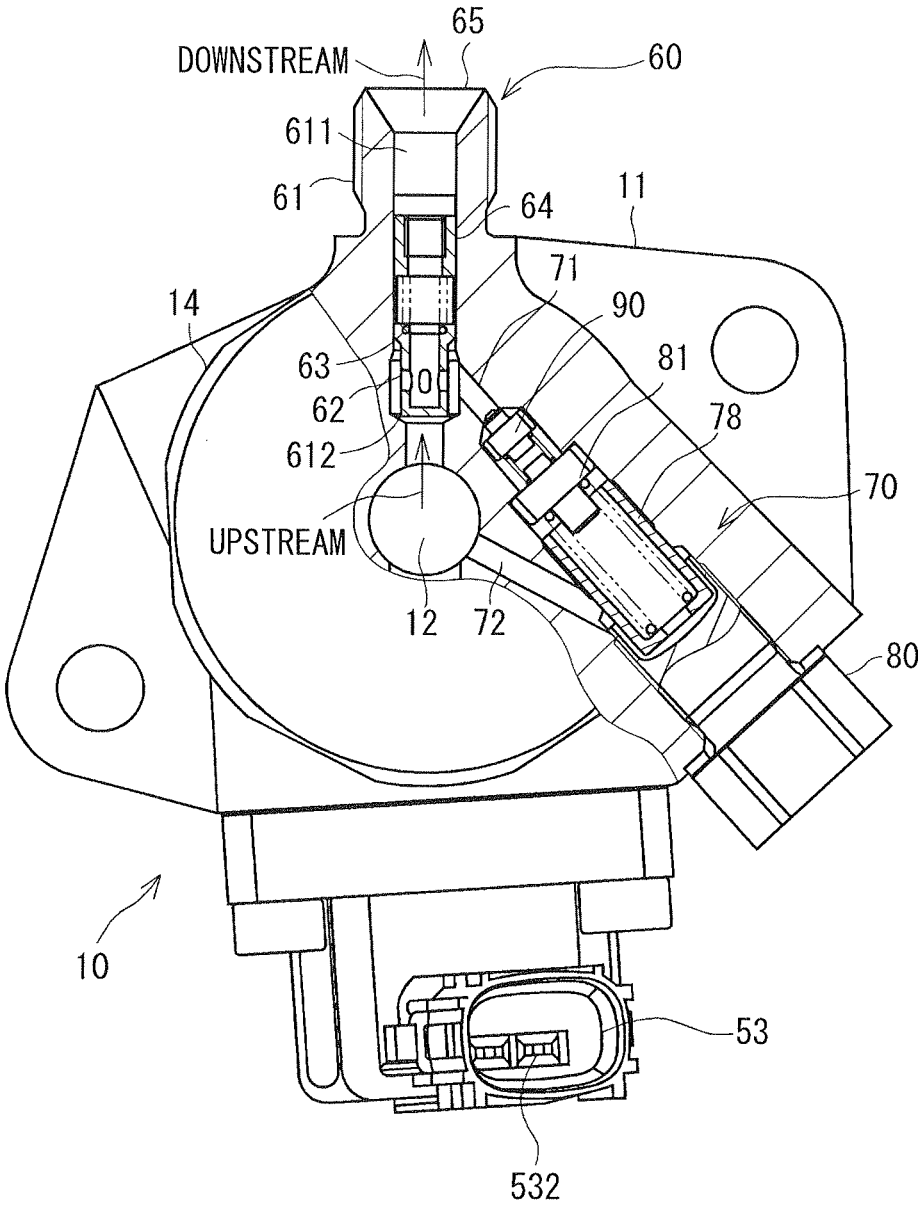
FIG. 3 is partial cross-sectional view of a high pressure pump according to the first embodiment taken in a direction of an arrow III in FIG. 2.

Next, the discharge valve arrangement 60 will be described with reference to FIGS. 2 and 3. FIG. 3 is a plan view taken in a direction of an arrow III in FIG. 2 and shows a cross section of the discharge valve arrangement 60 and the check valve/relief arrangement 70.

The discharge valve arrangement 60 includes a receiving portion 61, which is formed by the pump body 11 and is configured into a cylindrical tubular form. A discharge valve 62, a spring 63 and an engaging portion 64 are received in a receiving chamber 611 formed in the receiving portion 61. An opening of the receiving chamber 611 forms a discharge outlet 65. A discharge valve seat 612 is formed in a depth portion of the receiving chamber 611, which is opposite from the discharge outlet 65.

The discharge valve 62 is urged against the discharge valve seat 612 by an urging force of the spring 63 and a pressure of fuel applied from the fuel rail 20. Thereby, when the pressure of fuel in the pressurizing chamber 12 is low, discharge of fuel from the pressurizing chamber 12 is stopped by the discharge valve 62. In contrast, when the force of the pressure of fuel in the pressurizing chamber 12 is larger than a sum of the urging force of the spring 63 and the force of the pressure of fuel in the fuel rail 20, the discharge valve 62 is moved toward the discharge outlet 65. In this way, the fuel, which is supplied to the receiving chamber 611, is discharged from the discharge outlet 65.

The discharge valve 62 includes a fuel passage therein. Therefore, the fuel, which is supplied to a location radially outward of the discharge valve 62 upon the lifting of the discharge valve 62 from the discharge valve seat 612, is discharged from the discharge outlet 65 through the fuel passage of the discharge valve 62.

Next, the structure of the check valve/relief arrangement 70 will be described with reference to FIGS. 3 to 5C.

As shown in FIG. 3, the check valve/relief arrangement 70 is provided between a first return flow passage 71 and a second return flow passage 72. The first and second return flow passages 71, 72 communicate between a portion of the receiving chamber 611, which is located on a downstream side of the discharge valve seat 612, and the pressurizing chamber 12.

Figure 4A:
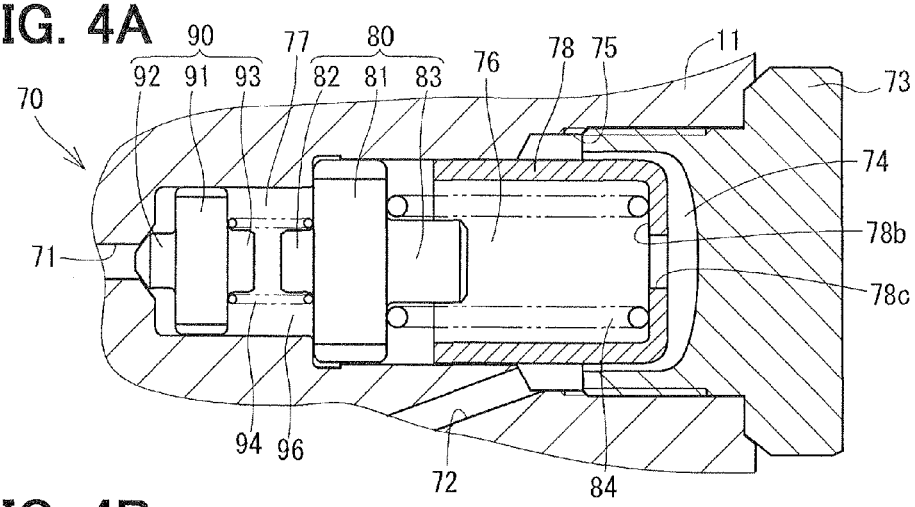
FIG. 4A is partial cross-sectional view showing a check valve closed state of the high pressure pump of the first embodiment.
Figure 4B:
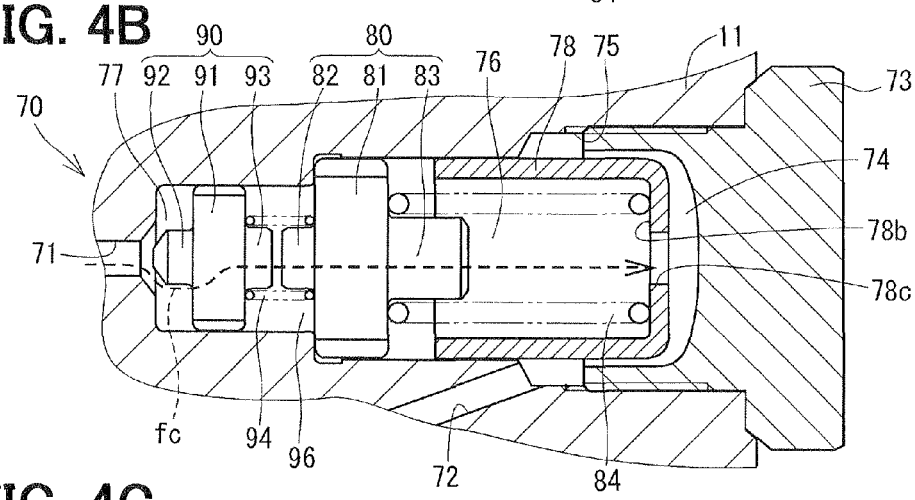
FIG. 4B is a partial cross-sectional view showing a check valve open state of the high pressure pump of the first embodiment.
Figure 4C:
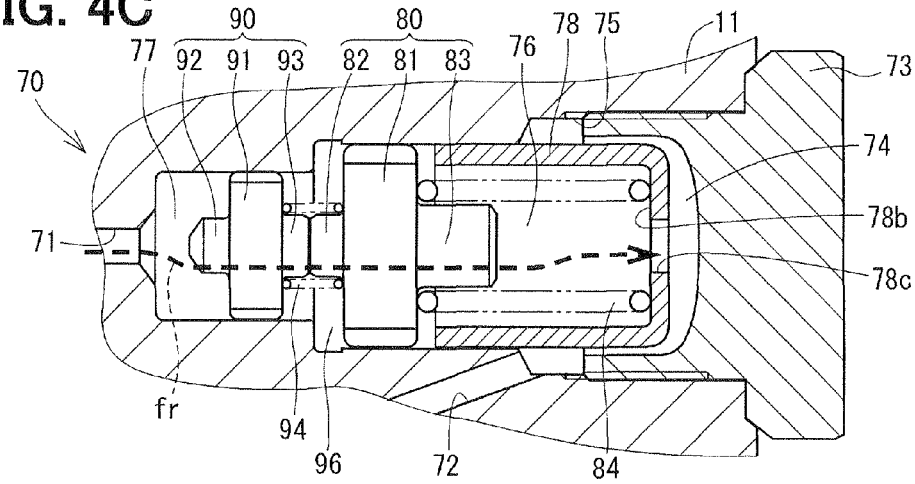
FIG. 4C is a partial cross-sectional view indicating a check valve open and relief state of the high pressure pump of the first embodiment.

The check valve/relief arrangement 70 includes the pump body 11, a valve element 90, a preset residual pressure spring 94, a movable member 80, a relief spring 84 and a spring holder 78 (see FIGS. 4A to 4C). The preset residual pressure spring 94 serves as a valve element urging means. The relief spring 84 serves as a movable member urging means.

In the following description, for the descriptive purpose, the left side of FIGS. 4A to 5C will be referred to as a front side, and the right side of FIGS. 4A to 5C will be referred to as a rear side.

A plug hole 75, a movable member receiving hole 76, a valve element receiving hole 77 and the first return flow passage 71 are coaxially arranged in this order in the pump body 11 such that an inner diameter thereof decreased in this order. The movable member receiving hole 76 and the valve element receiving hole 77 serve as a valve receiving hole.

A male thread is formed in the plug hole 75. One corner of a bottom portion of the plug hole 75 is communicated with the pressurizing chamber 12 through the second return flow passage 72. When the plug 73 is threadably engaged with the female thread of the plug hole 75, communication of the movable member receiving hole 76 to an outside of the high pressure pump 10 is blocked. Furthermore, a relief hole 74 is formed in the plug 73 to limit interference between the plug 73 and the spring holder 78.

The movable member receiving hole 76 receives the movable member 80 such that the movable member 80 is slidable along an inner peripheral wall (inner wall) 76*a* of the movable member receiving hole 76. A step surface 76*b* is formed at a boundary between the movable member receiving hole 76 and the valve element receiving hole 77 such that the step surface 76*b* extends in a direction generally perpendicular to the axial direction. The valve element receiving hole 77 receives the valve element 90 such that the valve element 90 is slidable along an inner peripheral wall (inner wall) 77*a* of the valve element receiving hole 77. A seat surface 77*c* is formed around an opening of the first return flow passage 71 and is tapered. The seat surface 77*c* serves as a valve seat.

Figure 5A:
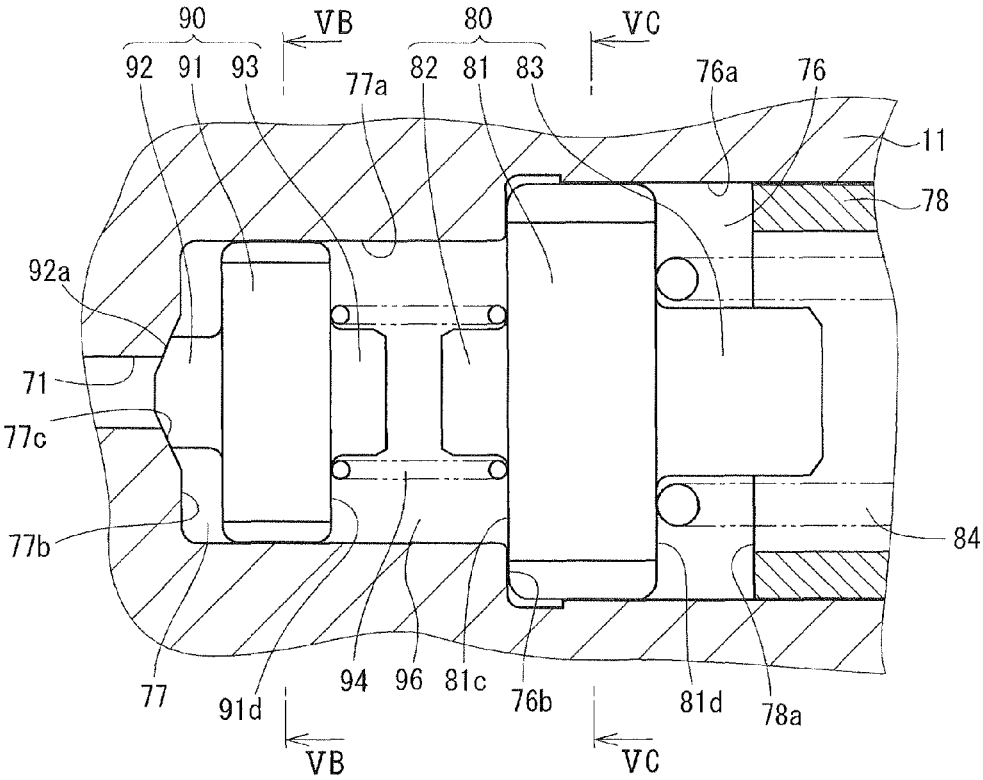
FIG. 5A is a partial enlarged view of FIG. 4A.
Figure 5B:
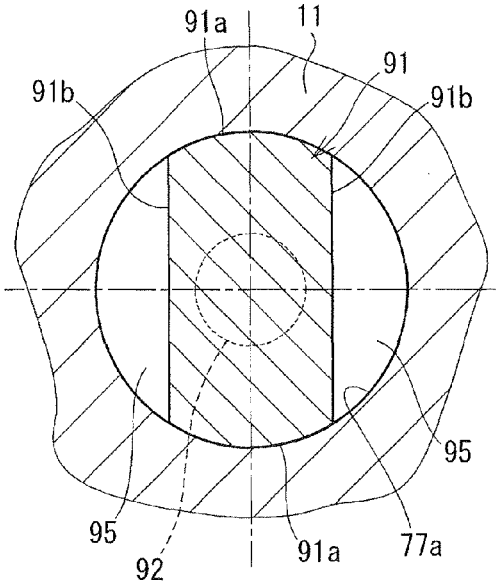
FIG. 5B is a cross-sectional view taken along line VB-VB in FIG. 5A.

The valve element 90 includes a main body 91, a valve portion 92 and a small diameter portion 93. As shown in FIG. 5B, an outer peripheral wall of the main body 91 includes two slide surfaces 91*a* and two planar surfaces 91*b*. The slide surfaces 91*a* are diametrically opposed to each other. The planar surfaces 91*b* are diametrically opposed to each other and connect between the slide surfaces 91*a*. The slide surfaces 91*a* slide along the inner peripheral wall 77*a* of the valve element receiving hole 77. Each of the planar surfaces 91*b* forms a flow passage 95 between the planar surface 91*b* and the inner peripheral wall 77*a* of the valve element receiving hole 77. The valve portion 92 is provided on the front side of the main body 91. A tapered part 92*a* is formed at a distal end part of the valve portion 92 and is seatable against the seat surface 77*c*. The small diameter portion 93 is provided on a rear side of the main body 91 and guides one end of the preset residual pressure spring 94.

The movable member 80 includes a main body 81, a first small diameter portion 82 and a second small diameter portion 83.

Figure 5C:
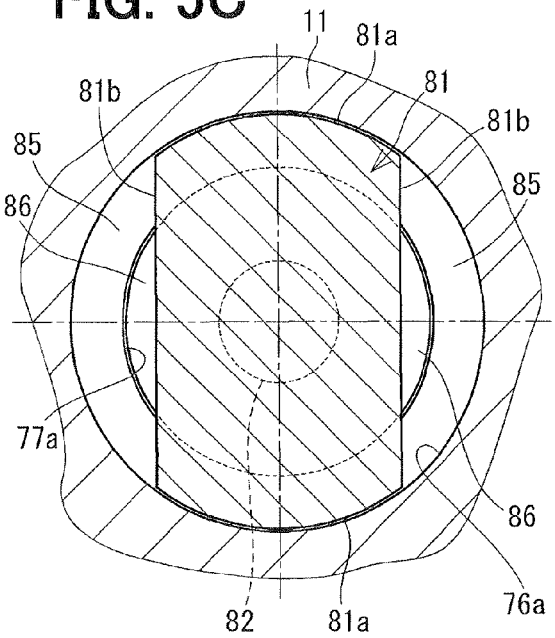
FIG. 5C is a cross-sectional view taken along line VC-VC in FIG. 5A.

As shown in FIG. 5C, an outer wall of the main body 81 includes two slide surfaces 81*a* and two planar surfaces 81*b*. The slide surfaces 81*a* are diametrically opposed to each other. The planar surfaces 81*b* are diametrically opposed to each other and connect between the slide surfaces 81*a*. The slide surfaces 81*a* slide along the inner peripheral wall 76*a* of the movable member receiving hole 76. Each of the planar surfaces 81*b* forms a relief flow passage 85 between the planar surface 81*b* and the inner peripheral wall 76*a* of the movable member receiving hole 76.

A preset residual pressure spring chamber 96 is formed by a rear end surface 91*d* of the main body 91 of the valve element 90 located on the movable member 80 side, a front end surface 81*c* of the main body 81 of the movable member 80 and the inner peripheral wall 77*a* of the valve element receiving hole 77.

In a state where the front end surface 81*c* of the main body 81 of the movable member 80 located on the valve element receiving hole 77 side contacts the step surface 76*b* (see FIG. 5A), a choked flow passage (orifice passage) 86 is formed by each of the planar surfaces 81*b* of the main body 81 of the movable member 80 and the inner peripheral wall 77*a* of the valve element receiving hole 77. The choked flow passages 86 communicate between the preset residual pressure spring chamber 96 (one side of the movable member 80) and the movable member receiving hole 76 (other side of the movable member 80) to enable flow of a small quantity of fuel therethrough.

Specifically, the movable member 80 does not have a function of fluid-tightly sealing the fuel upon movement of the movable member 80 toward the valve element 90. Therefore, a high surface processing accuracy is not required at the contact between the front end surface 81*c* and the step surface 76*b*. Specifically, even in a case where a clearance is formed at the contact between the front end surface 81*c* and the step surface 76*b* due to presence of, for example, a tilt surface or wavy surface in one or both of the front end surface 81*c* of the movable member 80 and the step surface 76*b* of the pump body 11, such a clearance will not have a substantial influence as long as a size of the clearance is smaller than a cross-sectional area of the choked flow passages 86.

Furthermore, the first small diameter portion 82 is provided on the front side of the main body 81 such that the first small diameter portion 82 is opposed to the small diameter portion 93 of the valve element 90. The first small diameter portion 82 guides the other end of the preset residual pressure spring 94.

The second small diameter portion 83 is provided on a rear side of the main body 81, i.e., on the spring holder 78 side of the main body 81. The second small diameter portion 83 guides one end of the relief spring 84.

The spring holder 78, which is configured into a tubular form, is press fitted to the inner peripheral wall 77*a* of the valve element receiving hole 77 at a predetermined depth. The spring holder 78 includes an opening 78*a*, which receives the relief spring 84, at a movable member 80 side end portion of the spring holder 78. The spring holder 78 and the pump body 11 form a housing.

One end of the relief spring 84 contacts a rear end surface 81*d* of the main body 81 of the movable member 80, and the other end of the relief spring 84 contacts an inner bottom surface 78*b* of the spring holder 78. A communication hole 78*c* is formed at a center part of the inner bottom surface 78*b* to communicate between the movable member receiving hole 76 and the relief hole 74. In this way, the movable member receiving hole 76 is communicated with the pressurizing chamber 12 through the communication hole 78*c*, the relief hole 74 and the second return flow passage 72.

Next, the operating the high pressure pump 10 will be described.

(I) Intake Stroke

When the plunger 41 is moved downward from the top dead center toward the bottom dead center by the rotation of the camshaft 100, the volume of the pressurizing chamber 12 is increased, and thereby the pressure of fuel in the pressurizing chamber 12 is decreased. The discharge valve 62 is seated against the discharge valve seat 612 to close the discharge outlet 65. At this time, the energization of the coil 531 is stopped. Therefore, the movable core 534 and the needle 59 are moved toward the right side of FIG. 2 by the urging force of the spring 535. As a result, the needle 59 contacts the intake valve 57, and the intake valve 57 is kept in a valve open state. Thereby, the fuel is drawn from the intake chamber 55 into the pressurizing chamber 12.

In the intake stroke, the plunger 41 is moved downward, so that the volume of the variable volume chamber 15 is decreased. Therefore, the fuel of the variable volume chamber 15 is supplied to the fuel chamber 13 through the volume chamber passage 18.

In this instance, a ratio between the cross-sectional area of the large diameter portion 711 of the plunger 41 and the cross-sectional area of the variable volume chamber 15 is generally 1:0.6. Therefore, a ratio between the amount of increase in the volume of the pressurizing chamber 12 and the amount of decrease in the volume of the variable volume chamber 15 is generally 1:0.6. Thus, about 60% of the fuel, which is drawn into the pressurizing chamber 12, is supplied from the variable volume chamber 15 into the fuel chamber 13 through the volume chamber passage 18, and about 40% of the remaining fuel is drawn into the fuel chamber 13 from the fuel inlet.

(II) Metering Stroke

When the plunger 41 is moved upward from the bottom dead center toward the top dead center by the rotation of the camshaft 100, the volume of the pressurizing chamber 12 is decreased. At this time, the energization of the coil 531 is stopped until predetermined timing (predetermined time point), so that the intake valve 57 is held in the valve open state thereof. Thus, the low pressure fuel, which is drawn into the pressurizing chamber 12 once, is returned to the intake chamber 55 through the intake valve arrangement 50.

When the energization of the coil 531 is started at the predetermined timing during the upward movement of the plunger 41, the magnetic attractive force is generated between the stationary core 533 and the movable core 534. When this magnetic attractive force becomes larger than the urging force of the spring 535, the movable core 534 and the needle 59 are moved toward the stationary core 533 side (in the left direction in FIG. 2). In this way, the urging force of the needle 59 against the intake valve 57 is released, so that the intake valve 57 is moved in the left direction in FIG. 2 and is held in a valve closed state thereof.

(III) Pressurizing Stroke

Once the intake valve 57 is held in the valve closed state, the pressure of fuel in the pressurizing chamber 12 is increased in response to the upward movement of the plunger 41. When the force of the pressure of fuel of the pressurizing chamber 12, which is applied to the discharge valve 62, becomes larger than the sum of the urging force of the spring 63 and the force of the pressure of fuel applied to the discharge valve 62 from the downstream side of the discharge outlet 65, the discharge valve 62 is lifted away from the discharge valve seat 612 and is thereby opened. In this way, the high pressure fuel, which is pressurized in the pressurizing chamber 12, is discharged from the discharge outlet 65.

In the middle of the pressurizing stroke, the energization of the coil 531 is stopped. The force of the pressure of fuel in the pressurizing chamber 12, which is applied to the intake valve 57, is larger than the urging force of the spring 535, so that the intake valve 57 is kept in the valve closed state thereof.

In the metering stroke and the pressurizing stroke, the volume of the variable volume chamber 15 is increased by the upward movement of the plunger 41, so that the fuel of the fuel chamber 13 is supplied to the variable volume chamber 15 through the variable volume chamber passage 18. At this time, about 60% of the volume of the low pressure fuel, which is discharged from the pressurizing chamber 12 to the fuel chamber 13, is drawn from the fuel chamber 13 into the variable volume chamber 15.

As discussed above, the high pressure pump 10 repeats the intake stroke, the metering stroke and the pressurizing stroke, so that the drawn fuel is pressurized and is discharged toward the fuel rail 20. The fuel rail 20 accumulates the discharged fuel.

The high pressure fuel, which is accumulated in the fuel rail 20, is injected from each corresponding fuel injection valve 21 upon energization thereof from an undepicted electronic control unit (ECU). At this time, the ECU outputs a pulse signal, which drives the fuel injection valve 21. A pulse width of the pulse signal is referred to as a fuel injection valve drive pulse width. The amount of fuel injected from the fuel injection valve 21 is controlled by the fuel injection valve drive pulse width and the pressure of fuel in the fuel rail 20.

When the pressure in the fuel rail 20 is equal to or smaller than a preset residual pressure (a predetermined value), the valve element 90 is seated against the seat surface 77*c* by the urging force of the preset residual pressure spring 94 and is thereby closed, as sown in FIG. 4A.

When the pressure in the fuel rail 20 becomes larger than the preset residual pressure, the valve element 90 is lifted away from the seat surface 77*c* against the urging force of the preset residual pressure spring 94 and is thereby opened, as shown in FIG. 4B. Then, the fuel, which is supplied from the first return flow passage 71 into the valve element receiving hole 77, is supplied into the movable member receiving hole 76 through the flow passages 95, the preset residual pressure spring chamber 96, the choked flow passages 86 and the relief flow passages 85 (see FIGS. 5B and 5C), as indicated by a dotted line fc in FIG. 4B. Then, the fuel is supplied into the pressurizing chamber 12 through the communication hole 78*c*, the relief hole 74 and the second return flow passage 72.

At this time, the fuel flows through the choked flow passages 86, and thereby the amount of fuel passing through the choked flow passages 86 toward the movable member receiving hole 76 is limited. In other words, the amount of fuel, which is supplied from the preset residual pressure spring chamber 96 to the movable member receiving hole 76, is limited.

The preset residual pressure is set such that the amount of fuel leaked from the fuel injection valve 21 upon the engine stop becomes smaller than its allowable amount, and the amount of vapor generated in the fuel rail 20 upon the engine stop becomes smaller than its allowable amount.

Thus, the fuel flows from the first return flow passage 71 to the second return flow passage 72, and thereby the pressure in the fuel rail 20 is decreased to a predetermined pressure. In this way, the leakage of fuel from the fuel injection valve 21 can be limited, and the generation of the vapor in the fuel rail 20 can be limited. That is, the valve element 90 and the seat surface 77*c* implement the function of the check valve (also referred to as a check valve function).

Now, the check valve function of the valve element 90 will be described with reference to FIGS. 6 to 8.

Figure 6:
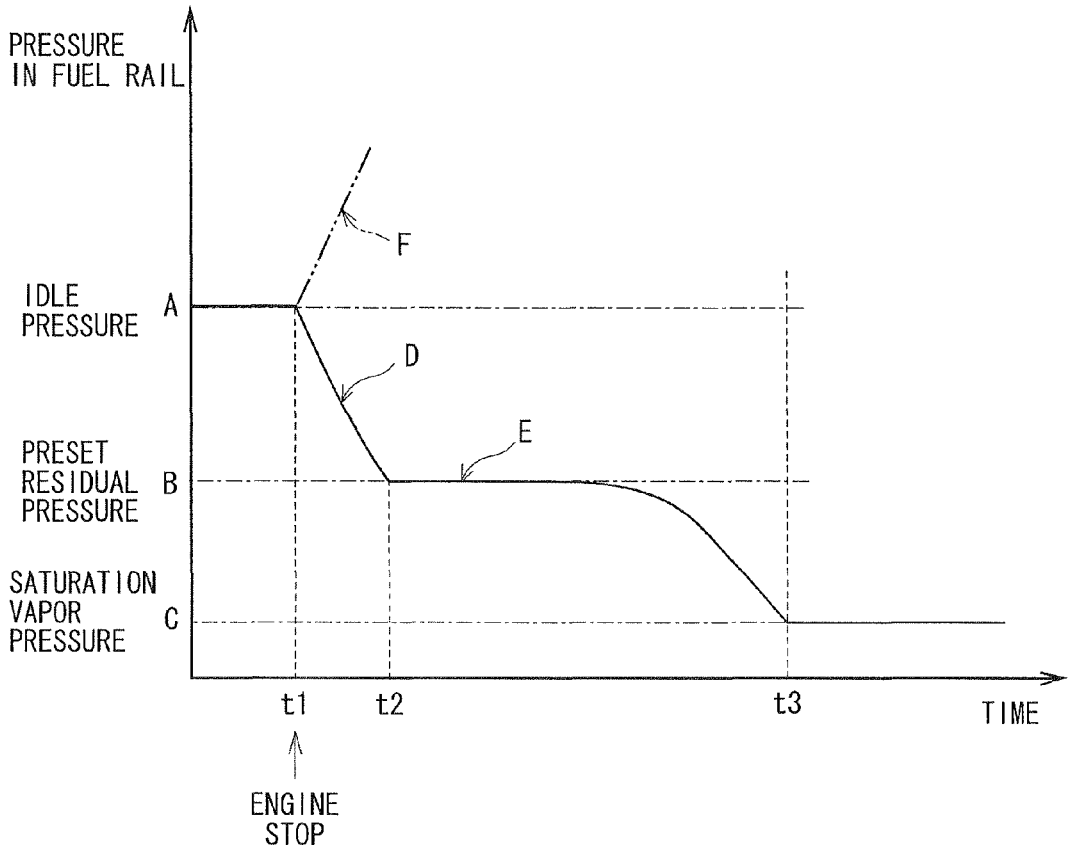
FIG. 6 is a diagram for describing transition of a pressure in a fuel rail.

(1) Advantages with Respect to a Pressure Increase in the Fuel Rail at the Time of Engine Stop FIG. 6 is a diagram showing the transition of the pressure in the fuel rail 20. Here, it is now assumed that the engine is stopped at the time t1. In general, the engine is driven in an idling state immediately before the engine stop. Therefore, the pressure of the fuel rail 20 at the time (time t1) of engine stop becomes an idle pressure A, which is a pressure of the fuel rail 20 at the time of driving the engine in the idling state.

At this time, when the idle pressure A is higher than the preset residual pressure B, the valve element 90 is lifted away from the seat surface 77*c* and is thereby opened. Thus, the fuel leaks from the first return flow passage 71 to the movable member receiving hole 76 through the valve element receiving hole 77 (see FIG. 4B). Therefore, the pressure in the fuel rail 20 decreases as indicated by an arrow D in FIG. 6. The decreasing speed of the pressure is determined by a size of a total cross sectional area of the choked flow passages 86. At the time t2, when the pressure in the fuel rail 20 is decreased to the preset residual pressure B, the check valve is closed.

Thereafter, when a balance between the increase in the pressure in the fuel rail 20 and the leak of the fuel is maintained, the pressure in the fuel rail 20 is kept at the preset residual pressure B, as indicated by an arrow E in FIG. 6. Thereafter, when the fuel rail 20 is progressively cooled, the pressure in the fuel rail 20 is progressively decreased. Thus, at the time t3, the pressure in the fuel rail 20 approaches the saturation vapor pressure C.

In a case where the high pressure pump does not have the check valve function, the pressure in the fuel rail 20 is increased from the engine stop time (time t1), as indicated by a dot-dot-dash line F in FIG. 6. Specifically, as indicated by a solid line G in FIG. 7, when the engine rotational speed becomes zero (0) at the time t1, the temperature of the fuel rail 20 is once increased (from the time t1 to the time t4) due to the high temperature of the engine room. Thereafter, the increased temperature of the fuel rail 20 is maintained for a while (from the time t4 to the time t5). Then, the temperature of the fuel rail 20 is decreased (the time t5 and thereafter). In response to this temperature change, as indicated by a dotted line H in FIG. 7, the pressure in the fuel rail 20 is changed in a similar manner that is similar to the temperature change. Therefore, the quantity (also referred to as a leaked fuel quantity) of leaked fuel, which is leaked from the fuel injection valve(s) 21, is increased, as indicated by a dotted line I in FIG. 7.

Figure 7:
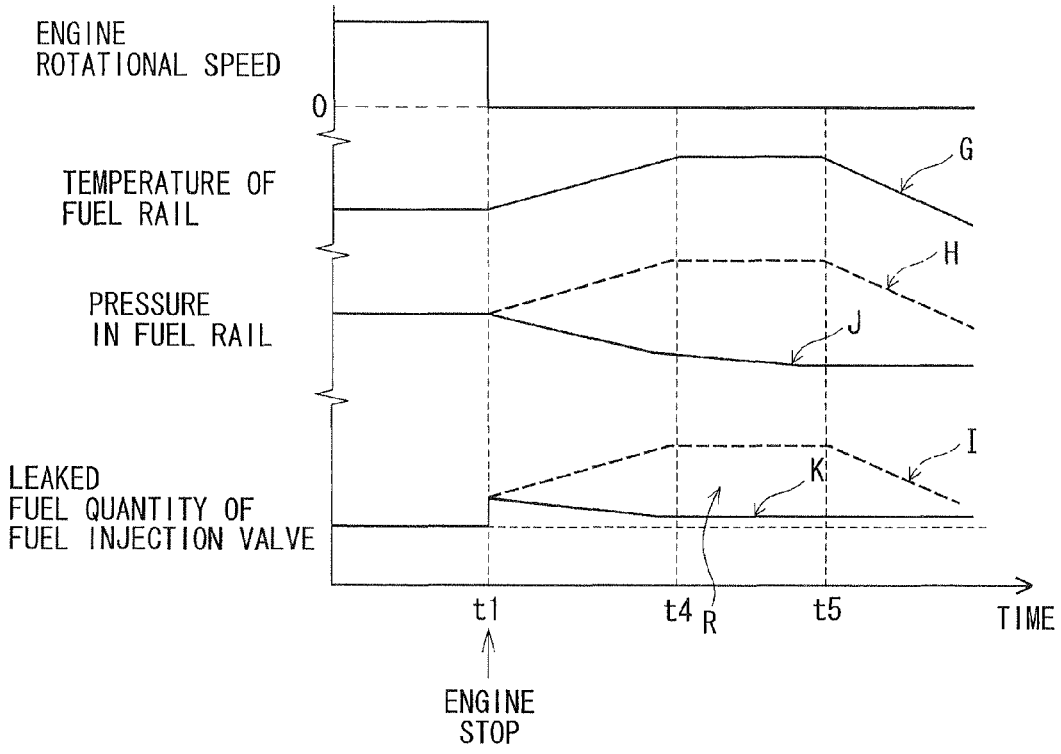
FIG. 7 is a diagram indicating leakage of fuel at a fuel injection valve caused by an increase in the temperature of the fuel rail.

In contrast, in the case where the high pressure pump has the check valve function, as indicated by a solid line J in FIG. 7, the pressure in the fuel rail 20 is decreased even when the temperature of the fuel rail 20 is increased. In this way, as indicated by a solid line K in FIG. 7, the fuel leakage from the fuel injection valve(s) 21 is limited. That is, excessive fuel leakage can be limited by the amount R, which is a difference between the dotted line I and the solid line K in FIG. 7.

Figure 8:
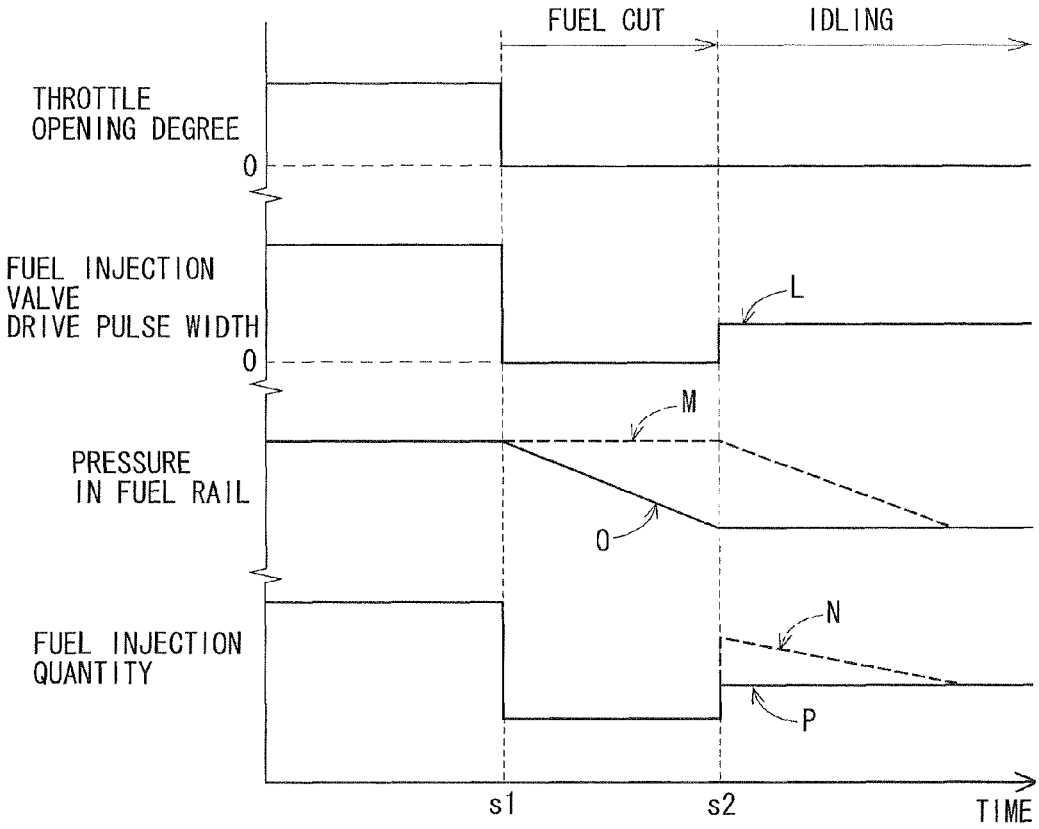
FIG. 8 is a diagram showing a fuel injection quantity at a fuel injection stop period as well as an engine speed reduction/idling state recovery period.

(2) Advantages with Respect to Stop of Fuel Injection Caused by Depressing Malfunction of the Accelerator Pedal FIG. 8 is a diagram indicating a change in a fuel injection quantity of the fuel injection valve 21 with time during an engine speed reduction/idling state recovery period. The engine speed reduction/idling state recovery period is a period, during which the operational state of the engine is returned to the idling state after stopping of depression of an accelerator pedal during the engine operation time.

When the depression of the accelerator pedal is stopped at the time s1, a throttle opening degree becomes smaller than a predetermined value. At this time, when the engine rotational speed is equal to or higher than a predetermined value, the fuel injection at the fuel injection valve 21 is stopped. Here, the stop of the fuel injection will be referred to as "fuel cut". Thereafter, when the engine rotational speed is decreased below the predetermined value, the operational state of the engine is shifted to the idling state (the time s2).

At this time, as shown in FIG. 8, the pulse width (fuel injection valve drive pulse width) of the drive pulse, which is outputted from the ECU to the fuel injection valve 21, is zero (0) during the period that is from the time s1, at which the fuel cut is started, to the time s2. After the time s2, the drive pulse, which has a relatively small pulse width (indicated by an arrow L in FIG. 8), is outputted from the ECU to the fuel injection valve 21 in order to change the fuel injection state of the fuel injection valve 21 to an appropriate state, which is suitable for the idling state of the engine.

In the comparative case where the high pressure pump does not have the check valve function, the fuel injection from the fuel injection valve 21 is not executed during the period from the time s1 to the time 2*s*, so that the pressure in the fuel rail 20 is maintained at the pressure of the fuel cut start time (the time s1), as indicated by a dotted line M in FIG. 8. Therefore, at the time s2, even when the drive pulse width of the fuel injection valve 21 is changed to the relatively small pulse width, an excessive quantity of fuel is injected from the fuel injection valve 21 due to the pressure of the fuel rail 20, as indicated by a dotted line N in FIG. 8.

In contrast, in the case of the present embodiment where the high pressure pump has the check valve function, the pressure in the fuel rail 20 can be reduced from the fuel cut start time (the time s1) due to the function of the check valve, as indicated by a solid line 0 in FIG. 8. Thereby, the fuel injection quantity of the fuel injection valve 21 at the time s2 can be made to the fuel injection quantity, which corresponds to the idling state, as indicated by a solid line P in FIG. 8. As a result, it is possible to limit the excessive fuel injection at the engine speed reduction/idling state recovery period. Thus, the deterioration in the fuel consumption can be limited, and thereby the driver of the vehicle will not have an annoying feeling, which would be otherwise caused by the excessive fuel injection.

(3) Advantages at the Time of Starting the Engine at High Temperature or (4) Advantages at the Time of Restarting the Engine after Idle Reduction As shown in FIG. 6, the preset residual pressure B is maintained from the time t2, and thereafter the pressure of the fuel rail 20 is maintained at or higher than the saturation vapor pressure. For example, the pressure of the fuel rail 20 is maintained during a period of 30 minute or 1 hour after the engine stop.

In this way, it is possible to limit deterioration in the startability of the engine at the time of restarting the engine at the high temperature. Furthermore, in an idle reduction system (also sometimes called idling-stop system), which temporarily stops the engine, it is possible to limit the deterioration in the startability of the engine after idle reduction (also referred to as idling-stop) like in the above-discussed case of the engine restart at the high temperature.

Referring back to FIG. 4C, when the pressure in the fuel rail 20 is further increased, the movable member 80 is moved toward the spring holder 78 side (the right direction in FIG. 4C) because of the pressure increase in the preset residual pressure spring chamber 96. When the front end surface 81*c* (see FIG. 5A) of the main body 81 of the movable member 80 is spaced from the step surface 76*b* (FIG. 5A), the flow passage cross-sectional area between the front end surface 81*c* and the step surface 76*b* is increased. Therefore, each space, which is defined between the inner peripheral wall 77*a* of the valve element receiving hole 77 and the corresponding one of the planar surfaces 81*b* of the main body 81 of the movable member 80, no longer functions as the choked flow passage, which limits the flow quantity of fuel that passes therethrough toward the movable member receiving hole 76. Thus, in comparison to the state of FIG. 4B, a larger amount of fuel can flow from the preset residual pressure spring chamber 96 to the movable member receiving hole 76 through the relief flow passage 85, as indicated by a dotted line fr in FIG. 4C.

Thus, a large quantity of fuel is relieved from the first return flow passage 71 to the second return flow passage 72. In this way, when the pressure in the fuel rail 20 is increased to the abnormally high pressure beyond the permissible range, the excess pressure is relieved to limit damage of, for example, the fuel injection valve 21. That is, the movable member 80 implements the relief function.

Next, the high pressure pump 10 of the present embodiment will be described in comparison with the previously proposed high pressure pump.

In the case of the previously proposed high pressure pump, in which the check valve is placed in the relief valve, the valve seat, against which the valve element of the relief valve is seated, and the valve seat, against which the valve element of the check valve is seated, need to be formed with the corresponding level of high precision, which can implement the fluid-tightness upon the seating of the corresponding valve element thereto. This results in the increase in the number of the processing steps and the processing costs.

In contrast, in the high pressure pump 10 of the present embodiment, the valve element 90 and the movable member 80 are driven in two steps by the pressure in the fuel rail 20 to implement the check valve function and the relief function. Furthermore, according to the present embodiment, the fluid tightness is not required between the front end surface 81*c* of the main body 81 of the movable member 80 and the step surface 76*b*. Therefore, the number of the processing steps and the processing costs can be reduced.

Furthermore, in the present embodiment, each space, which is defined between the inner peripheral wall 77*a* of the valve element receiving hole 77 and the corresponding one of the planar surfaces 81*b* of the main body 81 of the movable member, forms the corresponding choked flow passage 86, which limits the flow quantity of fuel (the amount of fuel) that passes therethrough. Therefore, it is not required to form the choked flow passage by a process of forming a fine hole, and thereby it is possible to reduce the number of processing steps.

Second Embodiment

Next, a high pressure pump according to a second embodiment of the present invention will be described with reference to FIGS. 9A to 10C. In the following embodiments, similar components will be indicated by the same reference numerals and will not be described redundantly for the sake of simplicity.

In the second embodiment, a choked flow passage (orifice passage) 87*h* is formed to extend through the movable member 87 along a central axis of the movable member 87. The choked flow passage 87*h* communicates between the preset residual pressure spring chamber 96 (one side of the movable member 87) and the movable member receiving hole 76 (other side of the movable member 87) to enable flow of a small quantity of fuel therethrough.

Figure 10A:
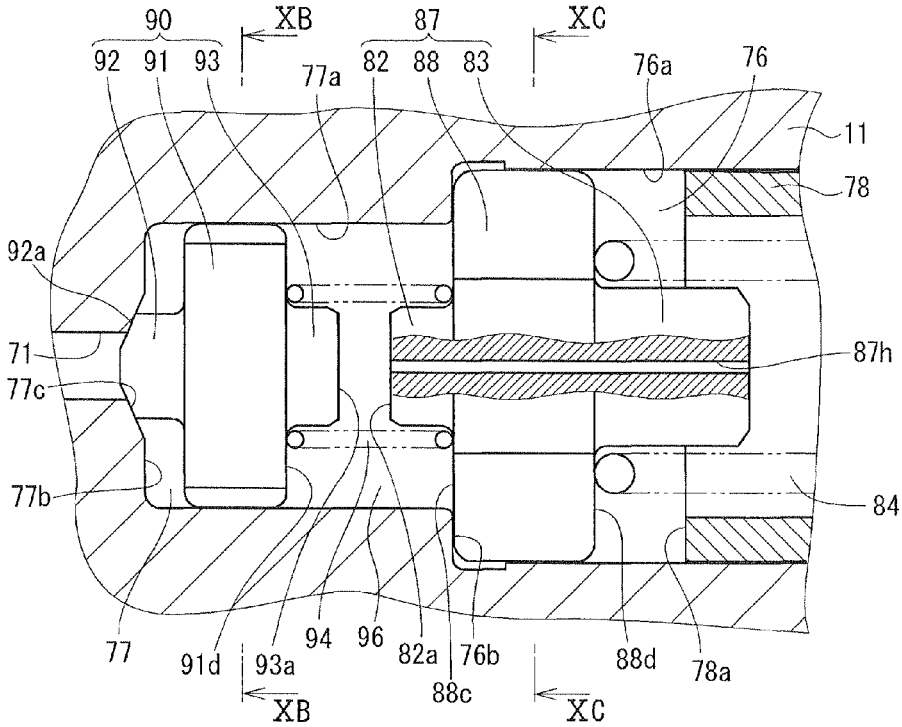
FIG. 10A is a partial enlarged view of FIG. 9A.
Figure 10B:
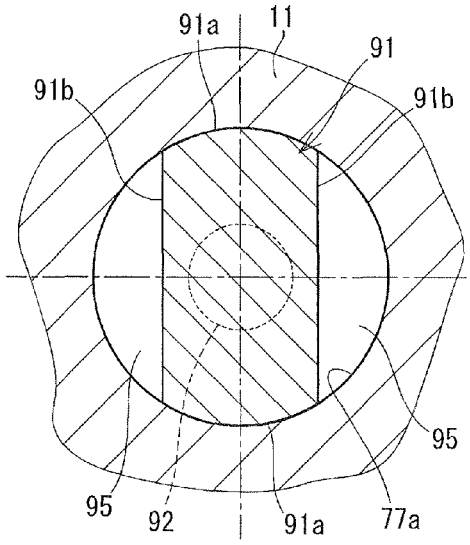
FIG. 10B is a cross-sectional view taken along line XB-XB in FIG. 10A.
Figure 10C:
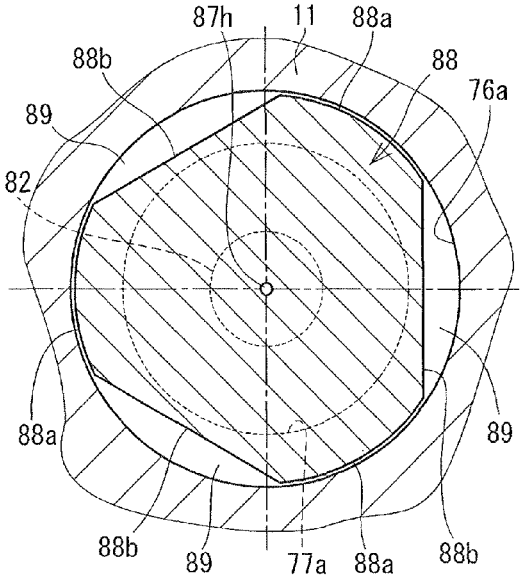
FIG. 10C is a cross-sectional view taken along line XC-XC in FIG. 10A.

Furthermore, as shown in FIG. 10C, an outer wall of the main body 88 of the movable member 87 includes three slide surfaces 88*a* and three planar surfaces 88*b*. The slide surfaces 88*a* slide along the inner peripheral wall 76*a* of the movable member receiving hole 76. Each of the planar surfaces 88*b* forms a relief flow passage 89 between the planar surface 88*b* and the inner peripheral wall 76*a* of the movable member receiving hole 76. Furthermore, in the state where a front end surface 88*c* of the main body 88 located on the valve element receiving hole 77 side contacts the step surface 76*b* (see FIG. 10A), a choked flow passage is not formed between each of the planar surfaces 88*b* of the main body 88 of the movable member 87 and the inner peripheral wall 77*a* of the valve element receiving hole 77. This is different from the first embodiment.

Figure 9A:
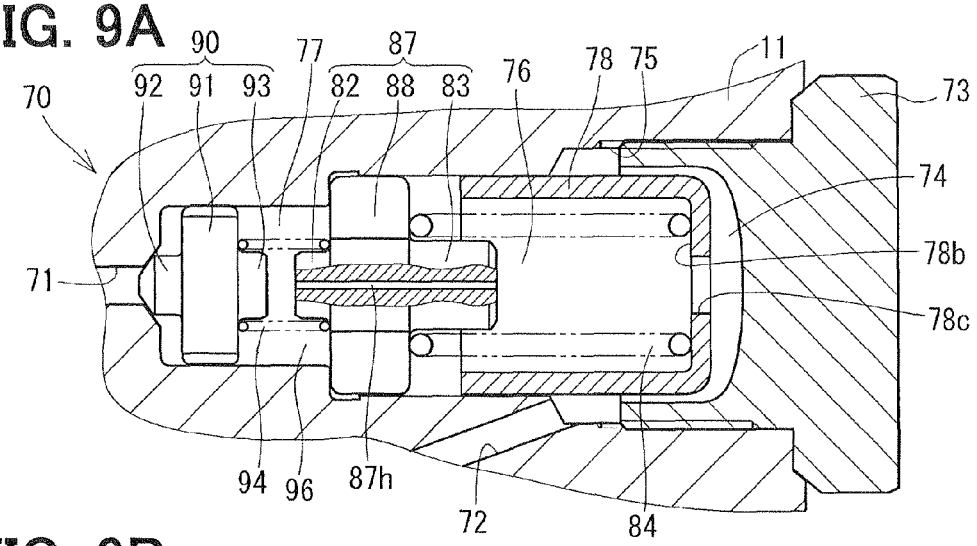
FIG. 9A is partial cross-sectional view showing a check valve closed state of a high pressure pump of a second embodiment of the present invention.

When the pressure in the fuel rail 20 is equal to or smaller than the preset residual pressure, the valve element 90 is seated against the seat surface 77*c* by the urging force of the preset residual pressure spring 94 and is thereby closed, as shown in FIG. 9A.

Figure 9B:
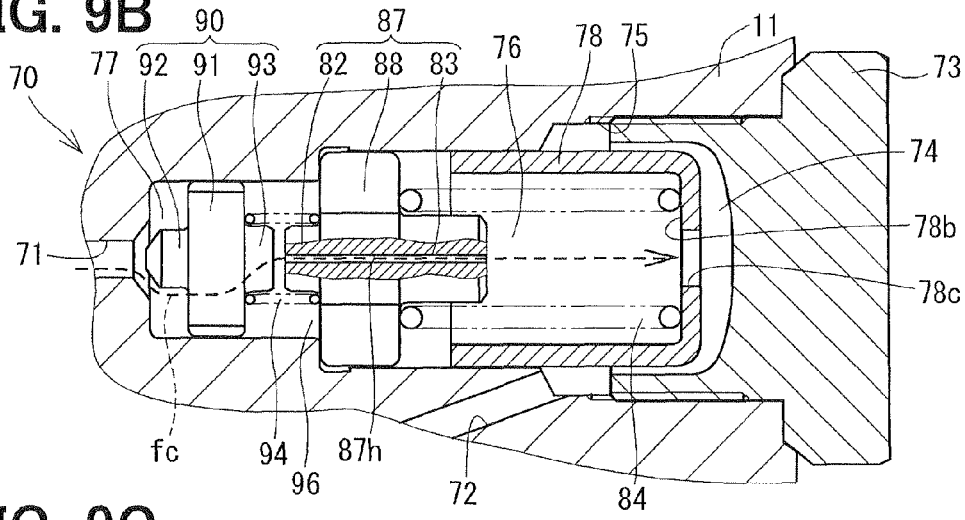
FIG. 9B is a partial cross-sectional view showing a check valve open state of the high pressure pump of the second embodiment.
Figure 9C:
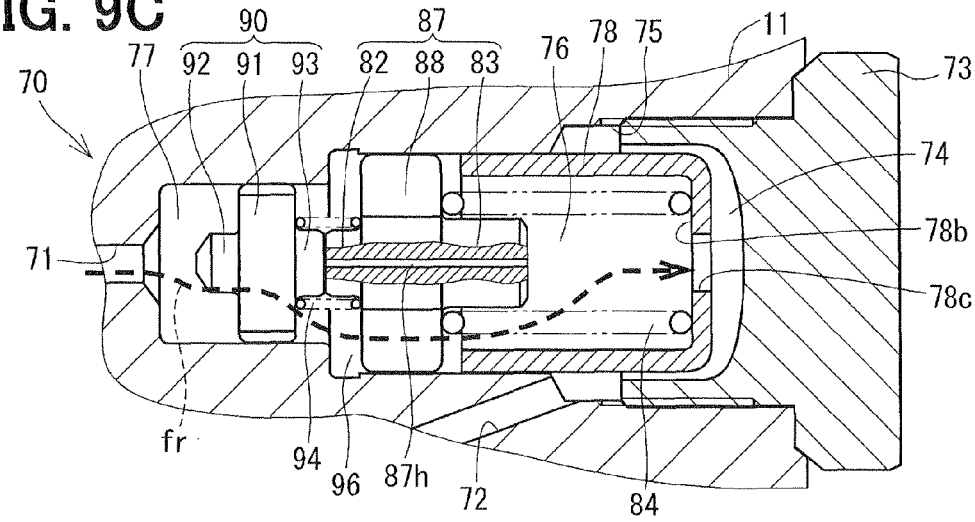
FIG. 9C is a partial cross-sectional view indicating a check valve open and relief state of the high pressure pump of the second embodiment.

When the pressure in the fuel rail 20 becomes larger than the preset residual pressure, the valve element 90 is lifted away from the seat surface 77*c* against the urging force of the preset residual pressure spring 94 and is thereby opened, as shown in FIG. 9B. Then, the fuel, which is supplied from the first return flow passage 71 into the valve element receiving hole 77, is supplied into the movable valve member receiving hole 76 through the flow passages 95 (see FIG. 10B), the preset residual pressure spring chamber 96 and the choked flow passage 87*h*, as indicated by a dotted line fc in FIG. 9B. Then, the fuel is supplied into the pressurizing chamber 12 through the communication hole 78*c*, the relief hole 74 and the second return flow passage 72.

At this time, the fuel flows through the choked flow passage 87*h*, so that the amount of fuel passing through the choked flow passage 87*h* is limited. In other words, the amount of fuel, which is supplied from the preset residual pressure spring chamber 96 to the movable member receiving hole 76, is limited.

When the pressure in the fuel rail 20 is further increased, an end surface 93*a* of the small diameter portion 93 of the valve element 90 approaches or contacts the end surface 82*a* of the first small diameter portion 82 of the movable member 87 (see FIG. 10A), so that the inflow of fuel into the choked flow passage 87*h* is limited or blocked. Then, due to the increase in the pressure of the preset residual pressure spring chamber 96, the movable member 87 is moved toward the spring holder 78 side (the right direction in FIG. 9C). Thus, fuel can flow from the preset residual pressure spring chamber 96 to the movable member receiving hole 76 through the relief flow passages 89, as indicated by a dotted line fr in FIG. 9C. Thus, in comparison to the state of FIG. 9B, a larger amount of fuel is relieved from the first return flow passage 71 to the second return flow passage 72.

In the second embodiment, similar to the first embodiment, the high surface processing accuracy is not required at the contact between the front end surface 88*c* of the main body 88 of the movable member 87 and the step surface 76*c*. Therefore, the number of processing steps and the processing costs can be reduced.

Furthermore, in the second embodiment, the choked flow passage 87*h* is formed by the movable member 87 alone, which is formed as a single integral component. Therefore, according to the present embodiment, the adjustment of the flow passage cross-sectional area of the choked flow passage and the size management of the corresponding components during the manufacturing are eased in comparison to the first embodiment, in which the choked flow passages 86 are formed by the combination of the multiple components, i.e., the combination of the movable member 80 and the pump body 11.

Third Embodiment

Next, a high pressure pump of a third embodiment of the present invention will be described with reference to FIG. 11.

Figure 11:
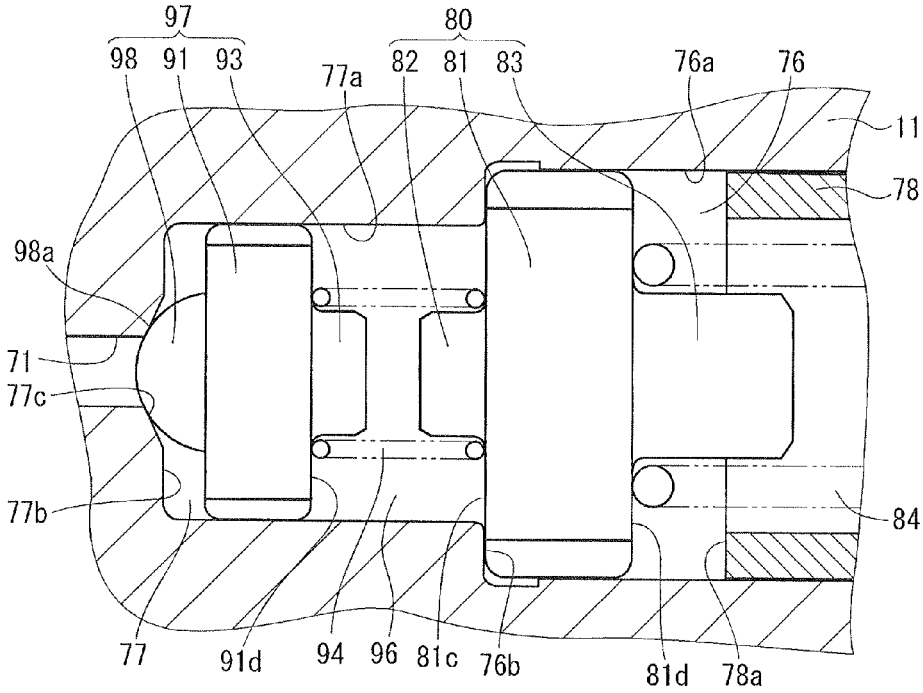
FIG. 11 is a partial enlarged cross sectional view of a high pressure pump in a check valve closed state according to a third embodiment of the present invention.

As shown in FIG. 11, the third embodiment differs from the first embodiment only with respect to the shape of the valve element. Specifically, the valve portion 98 of the valve element 97 of the third embodiment is configured to have a spherical surface and thereby has a spherical surface part 98*a*, which is seatable against the seat surface 77*c*. The valve element 97 can be easily formed by, for example, embedding a ball (a spherical body) into the main body 91.

Fourth Embodiment

Next, a high pressure pump of a fourth embodiment of the present invention will be described with reference to FIG. 12.

Figure 12:
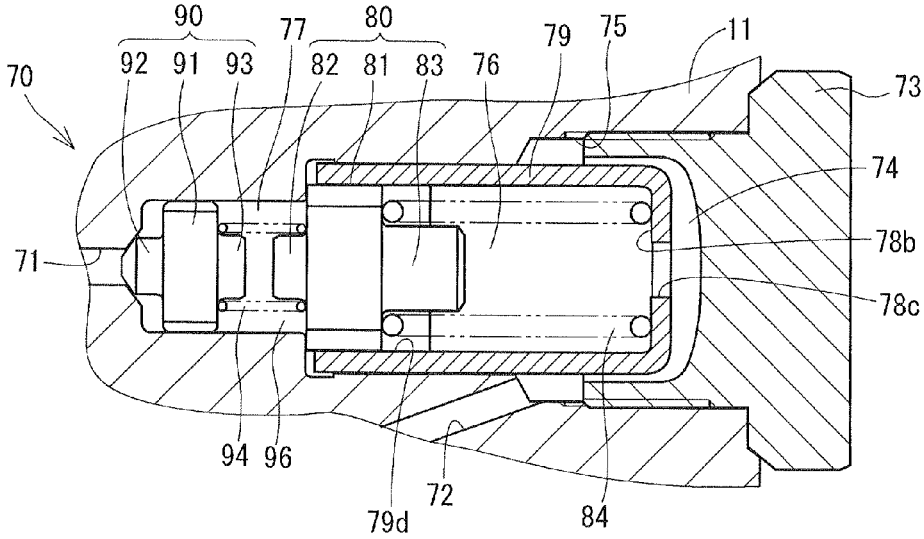
FIG. 12 is a partial enlarged cross sectional view of a high pressure pump in a check valve closed state according to a fourth embodiment of the present invention.

As shown in FIG. 12, the fourth embodiment differs from the first embodiment only with respect to the structure of the inner peripheral wall, along which the movable member 80 slides. Specifically, a spring holder 79 of the fourth embodiment extends deeper into the movable member receiving hole 76 in comparison to the spring holder 78 of the first embodiment. The movable member 80 slides along an inner peripheral wall 79*d* of the spring holder 79. The spring holder 79 and the pump body 11 form a housing.

In this way, the spring holder 79 can be processed alone by an inner diameter finishing process (internal cylinder grinding finishing process). Therefore, in comparison to a case where the pump body 11 is processed by the inner diameter finishing process, it is possible to achieve a required surface roughness (surface smoothness) and/or a required circularity, thereby enabling a reduction in the number of processing steps.

Now, modifications of the above embodiments will be described.

In the above embodiments, the valve element receiving hole 77, the first return flow passage 71, the second return flow passage 72 and the seat surface 77*c* are directly formed in the pump body 11. However, one or all of these parts can be formed individually in or in combination with a separate member(s), which is received in, for example, a hole of the pump body. In such a case, the separate member(s) forms a part(s) of the housing Furthermore, the movable member receiving hole 76 and the valve element receiving hole 77 may be formed integrally in a separate member. In such a case, this separate member may have the function of the spring holder, the function of receiving the movable member in a slidable manner and the function of the receiving the valve element in a slidable manner.

In the above embodiments, the plunger 41 has the large diameter portion 411 and the small diameter portion 412. However, the structure of the plunger is not limited to this. Furthermore, the variable volume chamber may be eliminated, if desired.

In the above embodiments, the cylinder 16 is integrally formed in the pump body 11. Alternatively, a separate cylinder may be installed to the pump body 11.

As discussed above, the present invention is not limited the above embodiments and modifications thereof. That is, the above embodiments and modifications thereof may be modified in various ways without departing from the sprit and scope of the invention.

What is claimed is:

1. A high pressure pump comprising:

a plunger;

a cylinder that receives the plunger, wherein the plunger is axially reciprocatable in the cylinder and forms a pressurizing chamber in cooperation with the cylinder to pressurize fuel in the pressurizing chamber upon reciprocation of the plunger in the cylinder;

a discharge valve that is provided at an outlet of the pressurizing chamber;

a housing that includes:

a first return flow passage that is communicated with an outlet of the discharge valve;

a second return flow passage that is communicated with an inlet of the discharge valve;

a valve receiving hole that is formed between the first return flow passage and the second return flow passage, wherein the first return flow passage opens to the valve receiving hole; and a valve seat that is formed at an opening of the first return flow passage;

a valve element that is received in the valve receiving hole, wherein the valve element is adapted to be seated against the valve seat when a pressure of fuel at an outlet side of the discharge valve is equal to or smaller than a predetermined value, and the valve element is adapted to be lifted away from the valve seat when the pressure of fuel at the outlet side of the discharge valve is larger than the predetermined value;

a movable member that is received in the valve receiving hole on a side of the valve element, which is opposite from the valve seat and is movable in an axial direction of the valve receiving hole;

valve element urging means for urging the valve element in a closing direction of the valve element toward the valve seat, wherein the valve element urging means is placed between the valve element and the movable member; and movable member urging means for urging the movable member toward the valve element by an urging force, which is larger than an urging force of the valve element urging means, wherein:

at least one choked flow passage is formed between one side of the movable member, at which the valve element is located, and the other side of the movable member, which is opposite from the valve element, wherein the at least one choked flow passage communicates between the one side of the movable member and the other side of the movable member and limits an amount of fuel, which passes from the one side of the movable member to the other side of the movable member, when the movable member is moved by the urging force of the movable member urging means toward the valve element; and a larger amount of fuel, which is larger than the amount of fuel that is passable through the at least one choked flow passage, flows from the first return flow passage to the second return flow passage, when the movable member is moved toward the other side, which is opposite from the valve element, against the urging force of the movable member urging means.

2. The high pressure pump according to claim 1, wherein the at least one choked flow passage is formed between an outer peripheral wall of the movable member and an inner wall of the valve receiving hole.

3. The high pressure pump according to claim 1, wherein the at least one choked flow passage is formed to extend through the movable member along a central axis of the movable member.

* * * * *